US007374671B2

(12) United States Patent
Blake

(10) Patent No.: US 7,374,671 B2
(45) Date of Patent: May 20, 2008

(54) LEAF AND DEBRIS CATCHER

(76) Inventor: Michael N. Blake, 5102 Clewis Ave., Tampa, FL (US) 33610

( * ) Notice: Subject to any disclaimer, the term of this patent is extended or adjusted under 35 U.S.C. 154(b) by 162 days.

(21) Appl. No.: 11/348,445

(22) Filed: Feb. 7, 2006

(65) Prior Publication Data

US 2007/0181475 A1 Aug. 9, 2007

(51) Int. Cl.
*B01D 35/00* (2006.01)

(52) U.S. Cl. ..... 210/167.19; 210/232; 210/416.2; 210/470; 4/496

(58) Field of Classification Search ..... 210/167.1, 210/232, 167.19, 416.1, 470, 416.2, 471, 210/776; 43/11; 4/496
See application file for complete search history.

(56) References Cited

U.S. PATENT DOCUMENTS

| | | | | |
|---|---|---|---|---|
| 3,625,364 | A | 12/1971 | La Chance | |
| 4,053,412 | A | 10/1977 | Stix | |
| 4,068,327 | A | 1/1978 | Heinlein | |
| 4,089,074 | A | 5/1978 | Sermons | |
| 4,224,166 | A * | 9/1980 | Wyman | 210/396 |
| 4,332,683 | A * | 6/1982 | Alt | 210/499 |
| 4,419,232 | A * | 12/1983 | Arntyr et al. | 210/164 |
| 4,455,695 | A | 6/1984 | Mikhel | |
| 4,781,827 | A | 11/1988 | Shields | |
| 4,869,010 | A * | 9/1989 | Saunders, Sr. | 43/9.2 |
| 4,944,101 | A * | 7/1990 | Goble | 15/1.7 |
| 4,950,393 | A | 8/1990 | Goettl | |
| 5,099,597 | A * | 3/1992 | Whistle | 43/11 |
| 5,135,647 | A * | 8/1992 | Childers | 210/136 |
| 5,173,181 | A | 12/1992 | McFarland | |
| 5,264,122 | A | 11/1993 | Lakotish | |
| 5,277,801 | A | 1/1994 | Lundquist | |
| 5,279,728 | A | 1/1994 | Weiss | |
| 5,288,414 | A | 2/1994 | Mongiello | |
| 5,350,508 | A | 9/1994 | Van der Watt | |
| 5,454,940 | A | 10/1995 | Lakotish | |

(Continued)

FOREIGN PATENT DOCUMENTS

WO WO 2004/042173 A1 5/2004

OTHER PUBLICATIONS

"Aqua Genie Swimming Pool Skimmer," website: http://www.poolwarehouse.com/Aqua-Genie-Skimmer.html, 5 pages, printed from the Internet on Dec. 15, 2005.

(Continued)

*Primary Examiner*—Fred Prince
(74) *Attorney, Agent, or Firm*—Christopher Wood; Wood & Eisenberg, PLLC

(57) ABSTRACT

A leaf and debris catcher for removing leaves and/or debris from a body of water. In one aspect of the invention, the leaf and debris catcher includes a base, a first vertical support member, a horizontal support member, a second vertical support member, and a leaf and debris collection member. In another aspect of the invention, a method is provided for removing leaves from a body of water. The method includes the steps of: providing a leaf and debris collection member; positioning the leaf and debris collection member in a body of water such that the leaf and debris collection member is located in a flow of water; collecting leaves in the leaf and debris collection member; removing the leaf and debris collection member from the flow of water; and removing leaves from the leaf and debris collection member.

10 Claims, 13 Drawing Sheets

U.S. PATENT DOCUMENTS

| | | | | |
|---|---|---|---|---|
| 5,487,830 | A | 1/1996 | Huppert | |
| 5,536,397 | A | 7/1996 | D'Offay | |
| 5,759,388 | A | 6/1998 | Cote | |
| 5,788,850 | A | 8/1998 | Tuomey | |
| 5,833,845 | A | 11/1998 | Anderson | |
| 5,849,184 | A | 12/1998 | Veillet | |
| 5,919,359 | A | 7/1999 | Bisseker | |
| 6,041,453 | A | 3/2000 | Barrow et al. | |
| 6,063,270 | A | 5/2000 | d'Offay | |
| 6,270,683 | B1 | 8/2001 | Turner | |
| 6,398,952 | B1 | 6/2002 | Baer | |
| 6,962,257 | B2 | 11/2005 | Upchurch et al. | |
| 7,247,236 | B2 * | 7/2007 | Desjoyaux et al. | 210/232 |
| 2002/0027097 | A1 * | 3/2002 | Baer | 210/169 |
| 2005/0011819 | A1 * | 1/2005 | Gillen et al. | 210/121 |

OTHER PUBLICATIONS

"Dragonfly Super Skimmer," website: http://www.abc.net.au/newinventors/txt/s1093763.htm, 4 pages, printed from the Internet on Dec. 15, 2005.

"Brand New Skimzit Automatic All Swimming Pool Skimmer," website: http://cgi.ebay.ca/BRAND-NEW-SKIMZIT-AUTOMATIC-ALL-SWIMMING-POOL-SKIMMER_W0QQitemZ4423316801QQcategoryZ66782QQcmdZViewItem, 15 pages, printed from the Internet on Dec. 15, 2005.

"New Kreepy Krauly Pool Cleaner Leaf Trap Canister," website: http://cgi.ebay.com/ws/eBayISAPI.dll?ViewItem&item=4410669497&category=66782, 6 pages, printed from the Internet on Dec. 15, 2005.

* cited by examiner

LEAF AND DEBRIS CATCHER

FIELD OF THE INVENTION

The present invention relates to leaf and debris catching devices and more specifically to a leaf and debris catcher that removes leaves and debris from water such as water found in swimming pools and water fountains.

DESCRIPTION OF THE RELATED ART

Families, park recreation services, condo and apartment complexes frequently have outdoor swimming pools that require maintenance and cleaning. Spending time cleaning a pool is less fun than using the pool. Thus, there is a need for cleaning devices that help remove leaves and debris that accumulate in swimming pools. Likewise, there is a need for devices that help remove leaves and debris that accumulate in water fountains.

Several efforts have been made to address removing debris and leaves from pools and/or water fountains. U.S. Pat. No. 6,041,453, issued Mar. 28, 2000 to Barrow et al., describes a jet directed debris skimmer for floating adjacent the surface of a pool to entrap floating debris including leaves. The '453 skimmer includes a floway having a front and a rear, with an entrance lip at the front, and a receptacle receiver at the rear.

U.S. Pat. No. 4,332,683, issued Jun. 1, 1982 to Alt, describes an adjustable and stationary holding apparatus for a swimming pool surface skim net comprising an elongated hollow main member provided with at least one hole at the top surface and coupled to at least one support foot member for support. The elongated hollow main member is connected to a skim net holding member to which the skim net is displaceably coupled. A skim net support member is coupled to the skim net to maintain the skim net in a fully expanded position.

U.S. Pat. No. 4,781,827, issued Nov. 1, 1988 to Shields, describes a portable swimming pool skimmer. The '827 skimmer can be positioned at any point along the periphery of a swimming pool. The portable skimmer includes a weighted base member from which extends in an outward and downward direction a bracket for holding a skimmer basket. The bracket is vertically adjustable so that the skimmer basket is positioned slightly below the water surface to allow a skimming action. At the bottom of the basket, a fitting to which one end of a pool hose may be attached is provided. The other end of the pool hose is attached to a suction line from the pool pump and filter assembly, which suction line may be a part of a built in skimmer or another hose from the built in skimmer to another device, such as an automatic pool cleaner. In the latter situation, a restriction in the skimmer hose is provided to minimize the suction pressure, which operates the pool-cleaning device. A debris guide is also provided to direct the floating debris towards the basket and is selectably positioned by the user in response to the current direction of the pool water. The bracket holding the skimmer basket is fabricated from tubular material and holes are provided in the tubular material to allow water to enter and prevent the bracket from floating.

U.S. Pat. No. 5,454,940, issued Oct. 3, 1995 to Lakotish, describes a pool cleaner and method for removing debris from the surface of a pool. The '940 pool cleaner is said to comprise a body having an open first end, open body sides, and a filtration second end, the body being generally hollow to form a conduit for water and having a water supply member which may be operably connected to a source of pressurized water. The body is supported by support means so that the body does not substantially interfere with the circulation of water through the open first end, the open body sides, or the filtration second end. A filter net is attached to the filtration second end of the body and one or more water jets are operably connected to the body for propelling water substantially toward the filter net to direct debris into the filter net.

U.S. Publication No. 20050011819, published Jan. 20, 2005 to Gillen, describes a static pool skimmer. In a preferred embodiment, the static pool skimmer is adapted to attach to a swimming pool railing and float on the surface of the water, collecting surface debris carried by a current.

None of the above inventions and patents, taken either singly or in combination, is seen to describe the instant invention as claimed.

SUMMARY OF THE INVENTION

A leaf and debris catcher for removing leaves and/or debris from a body of water. In one aspect of the invention, the leaf and debris catcher includes a base, a first vertical support member, a horizontal support member, a second vertical support member, and a leaf and debris collection member. In another aspect of the invention, a method is provided for removing leaves from a body of water. The method includes the steps of: providing a leaf and debris collection member; positioning the leaf and debris collection member in a body of water such that the leaf and debris collection member is located in a flow of water; collecting leaves in the leaf and debris collection member; removing the leaf and debris collection member from the flow of water; and removing leaves from the leaf and debris collection member.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is directed to debris catching devices and more specifically to a leaf and debris catching device that aids in the removal of leaves and debris from water such as water found in swimming pools and water fountains.

Figure 1:
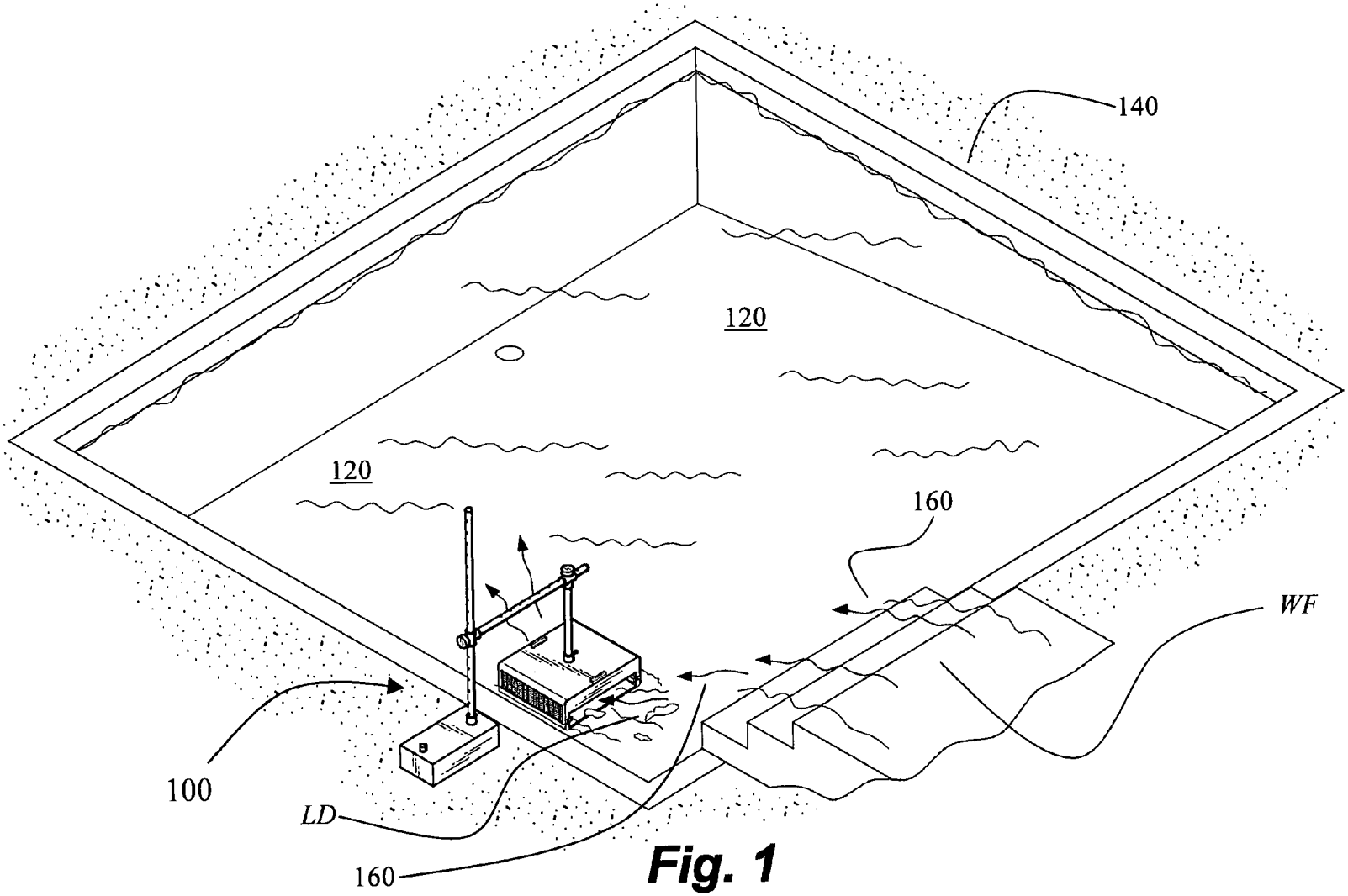
FIG. 1 is an environmental, perspective view of a leaf and debris catcher according to the present invention.

FIG. 1 shows an environmental, perspective view of a leaf and debris catcher 100 according to the invention. The leaf and debris catcher 100 is shown collecting leaves or debris from a body of water 120 in an in-ground swimming pool 140 and, more particularly, from water flow represented by arrows 160. The leaf and debris catcher 100 functions by taking advantage of water flow, and more particularly, leaves and debris (represented by the alpha-numeric label "LD") carried along in the water flow 160. In this example, a waterfall WF generates the water flow 160.

Figure 2:
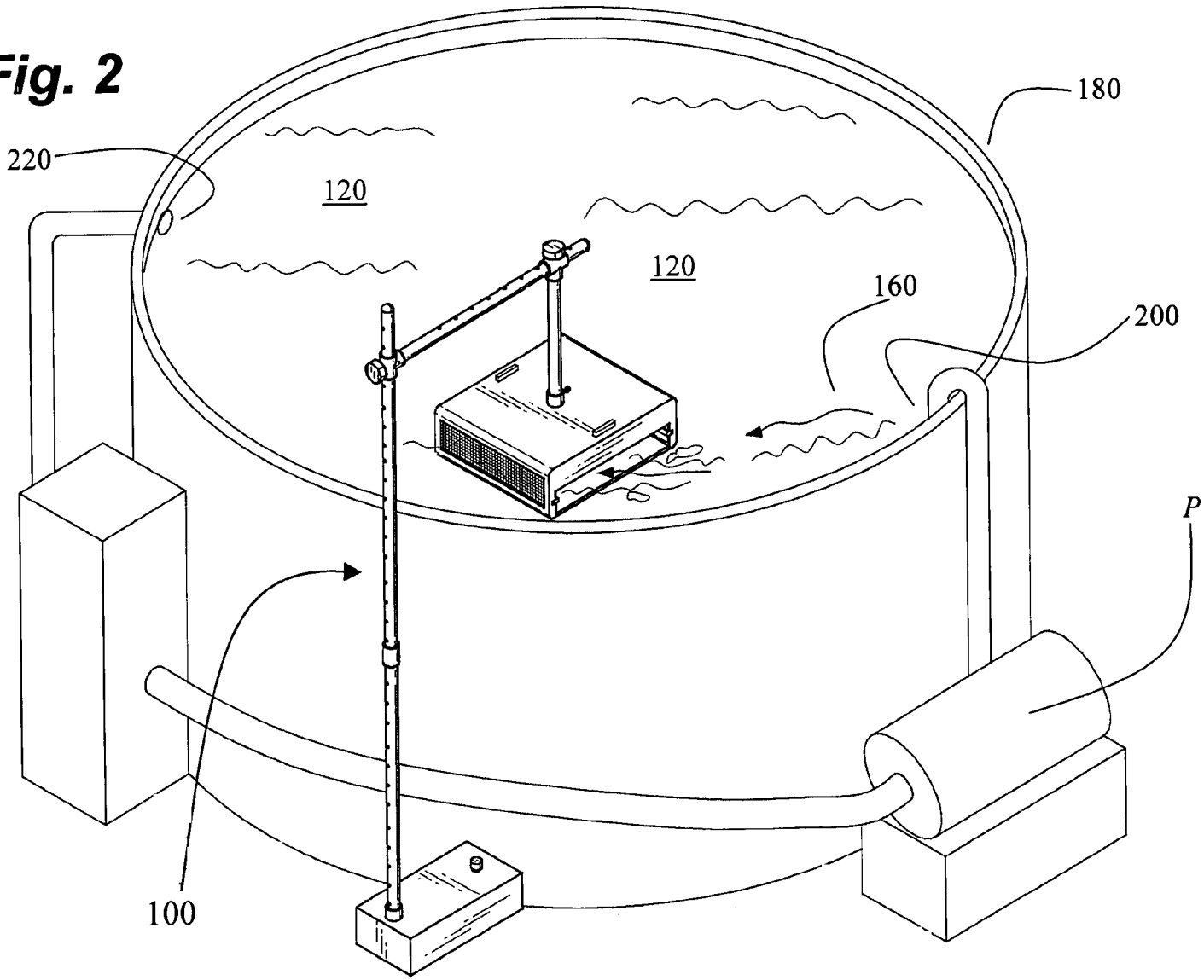
FIG. 2 is a further environmental, perspective view of a leaf and debris catcher according to the present invention.

FIG. 2 shows an environmental; perspective view of the leaf and debris catcher 100 according to the invention. The leaf and debris catcher 100 is shown collecting leaf or debris from a body of water 120 in an above ground swimming pool 180 and, more particularly, from water flow 160. The leaf and debris catcher 100 functions by taking advantage of water flow, and more particularly, leaves and debris (represented by the alpha-numeric label "LD") carried along in the water flow 160 directed from a swimming pool water outlet 200.

Typically, swimming pool water is re-circulated to add water treatment agents such as chlorine to keep the water safe and hygienic for swimmers. A pump P (see FIG. 2) typically pumps water 120 from a swimming pool via a water intake 220, thence through a water treatment unit to provide chemically treated water that is returned to the swimming pool through the water outlet 200. A flow of water 160 is typically generated in the swimming pool water 120 adjacent to the water outlet 200. The leaf and debris catcher 100 takes advantage of such water currents to remove debris and leaves from the swimming pool water 120 as shown in FIGS. 1 and 2. Thus, the leaf and debris catcher 100 is designed to take advantage of an outgoing jet of water emerging from, for example, a water outlet in a swimming pool. The leaf and debris catcher 100 can also be used to remove leaves and debris from a water fountain, wherein the leaf and debris catcher 100 is positioned to remove leaves and debris from water flows generated by the water fountain.

Figure 3:
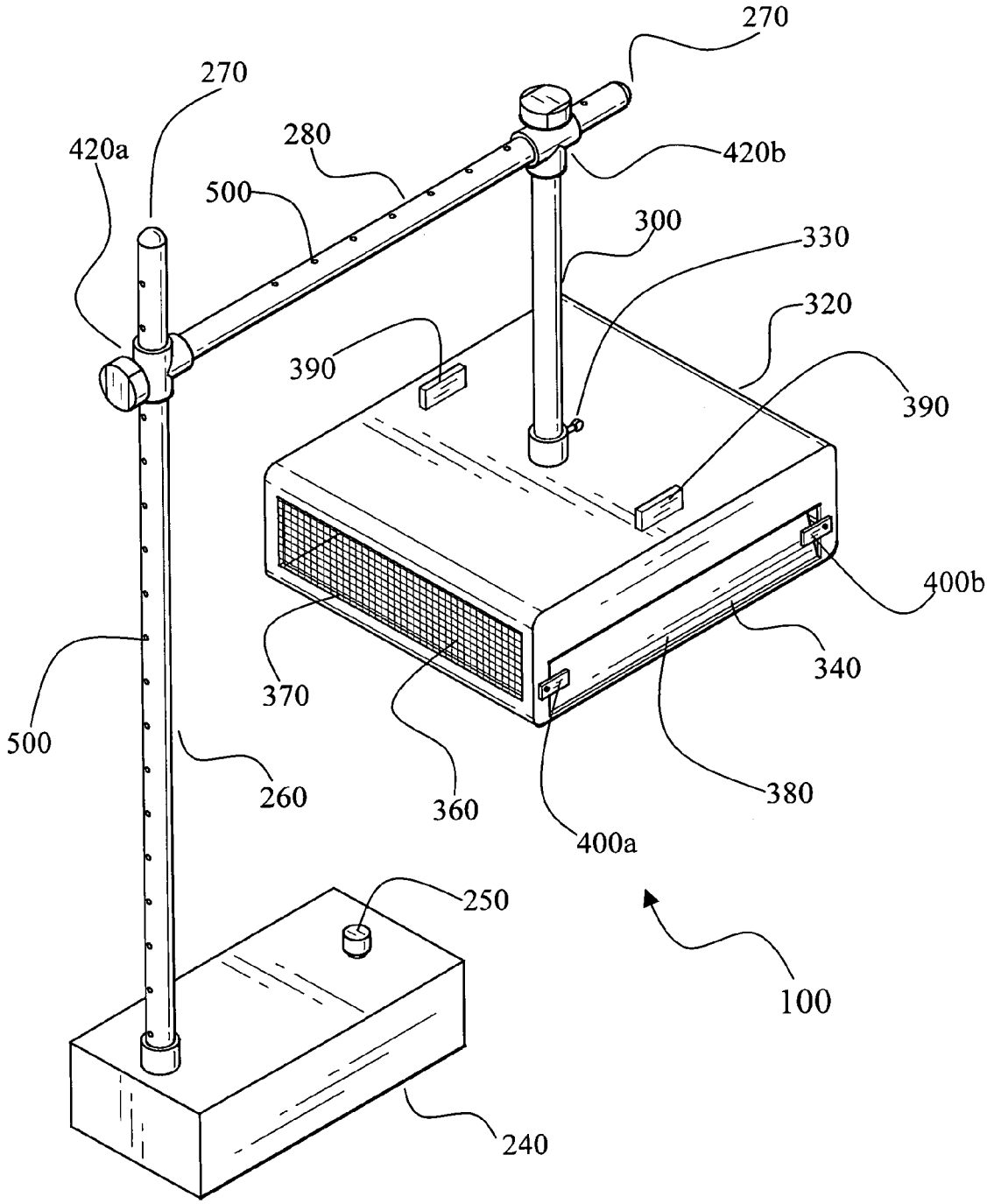
FIG. 3 is a perspective view of the leaf and debris catcher shown in FIGS. 1 and 2.

Referring to FIG. 3, the leaf and debris catcher 100 comprises a base 240, a first vertical support member 260, a horizontal support member 280, a second vertical support member 300, and a leaf and debris collection member 320. The base 240 can be essentially hollow and later filled with sand or water via a removable cap 250; objects can also be put or laid across the base such as one or more sandbags (not shown). The leaf and debris collection member 320 can take any suitable shape such as a generally rectangular box shape, as shown in FIG. 3. However, it should be understood that the leaf and debris collection member 320 can be any shape and possess any set of suitable dimensions (height, width, length) so long as it is capable of removing leaves and debris from water flowing into and through member 320. Optional cap ends 270 can be used to seal opens ends in members 260, 280 and 300 (see, for example, FIG. 3). If used, the cap ends 270 can be made out of any suitable material such as, but not limited to, rubber.

The components that make up the leaf and debris catcher 100 may be made of plastics or metal, or a combination of both plastics and metal. More than one material may be used in an individual component. For example, the tube sections 440 can be made of plastic alone, or a combination of plastic and metal such as light alloy tubes with a plastic coat. The sections of tubing 440 define optional apertures 500.

The leaf and debris collection member 320 comprises at least one water flow inlet member 340 and at least one water flow outlet member 360. The at least one water flow outlet member 360 retains leaves and solid debris inside the leaf and debris collection member 320. In FIG. 3, the at least one water flow inlet member 340 is represented by at least one flap 380, and the at least one water flow outlet member 360 is represented by at least one leaves sieve 370. It should be understood that the at least one water flow inlet member 340 can take any suitable form that allows water to flow into the leaf and debris collection member 320. Similarly, the at least one water flow outlet member 360 can take any suitable form, such as, but not limited to: a grill, netting, and any combination thereof. Optional handles 390 can be fitted to the leaf and debris collection member 320. A release mechanism 330 enables an operator to release the leaf and debris collection member 320 from the second vertical support member 300. The second vertical support member 300 has proximal and distal ends 310*a* and 310*b*, respectively (see FIG. 4). Typically, the proximal end 310*a* is attached to, and extends downward from, the horizontal support member 280, and the distal end 310*b* attached to the leaf and debris collection member 320. The terms "attached to" and "connected to" are regarded herein as equivalent terms.

Figure 5A:
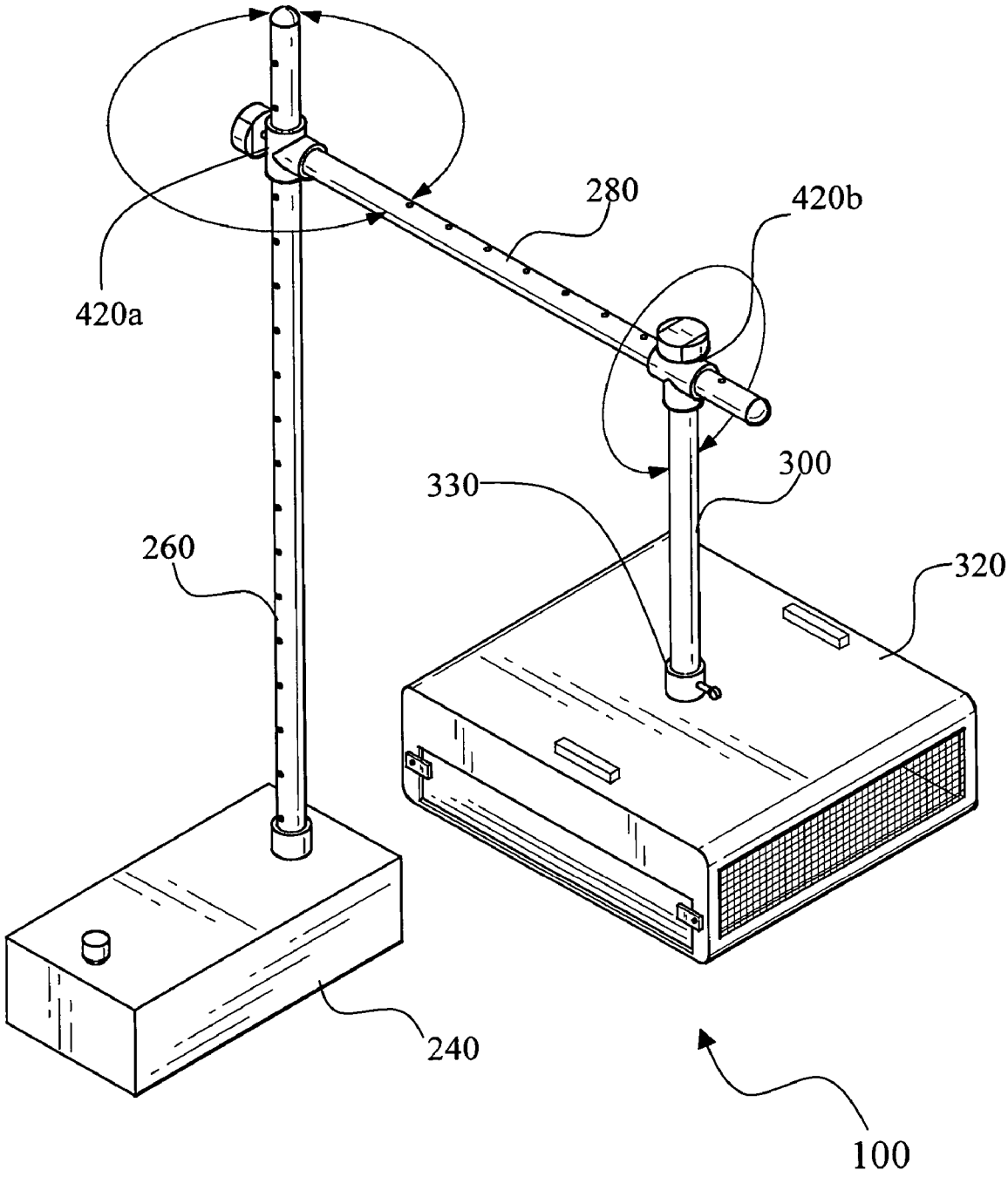
FIGS. 5A-5C show how the contents of the leaf and debris collection member can be emptied.
Figure 5B:
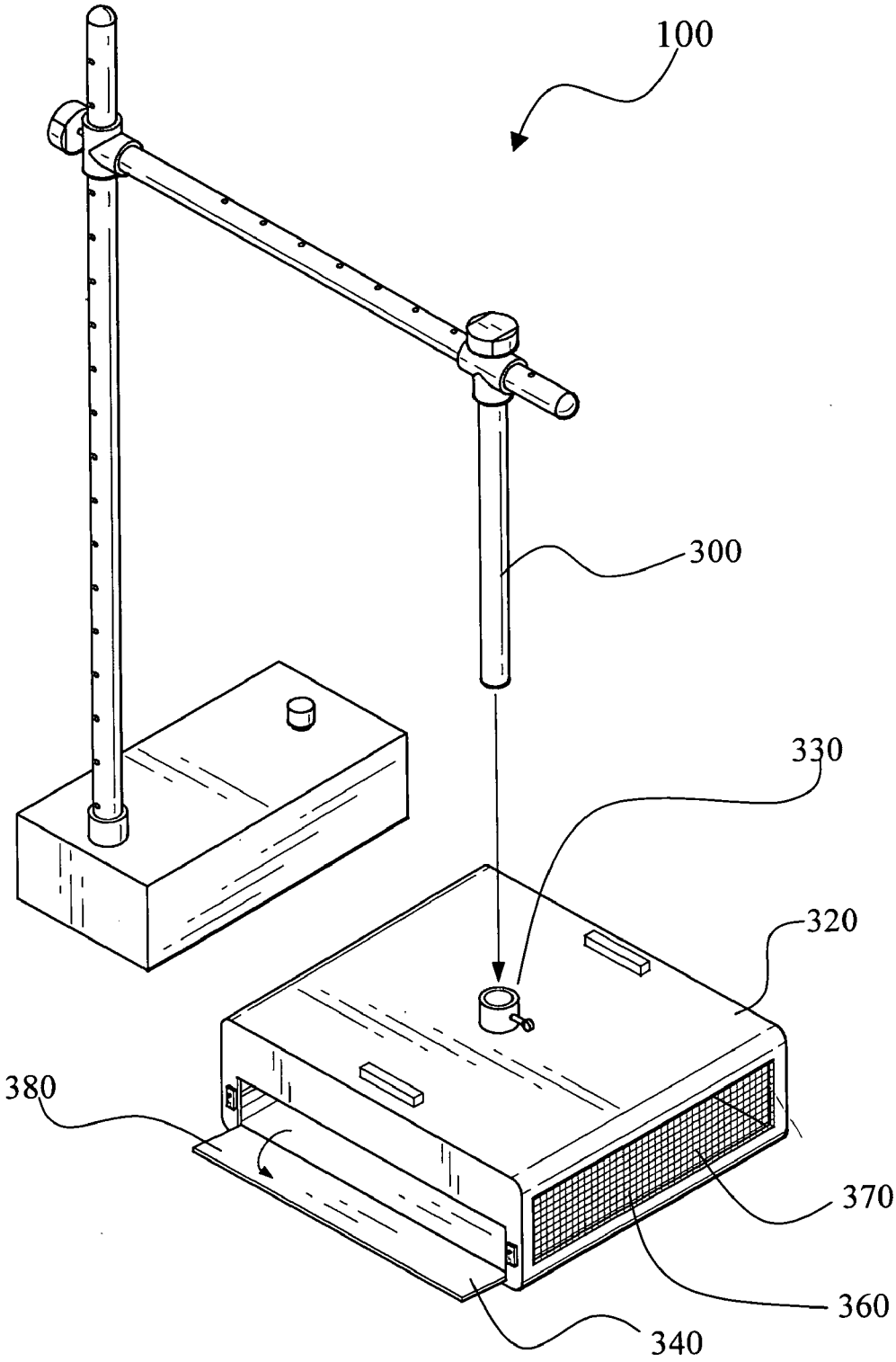
Figure 5C:
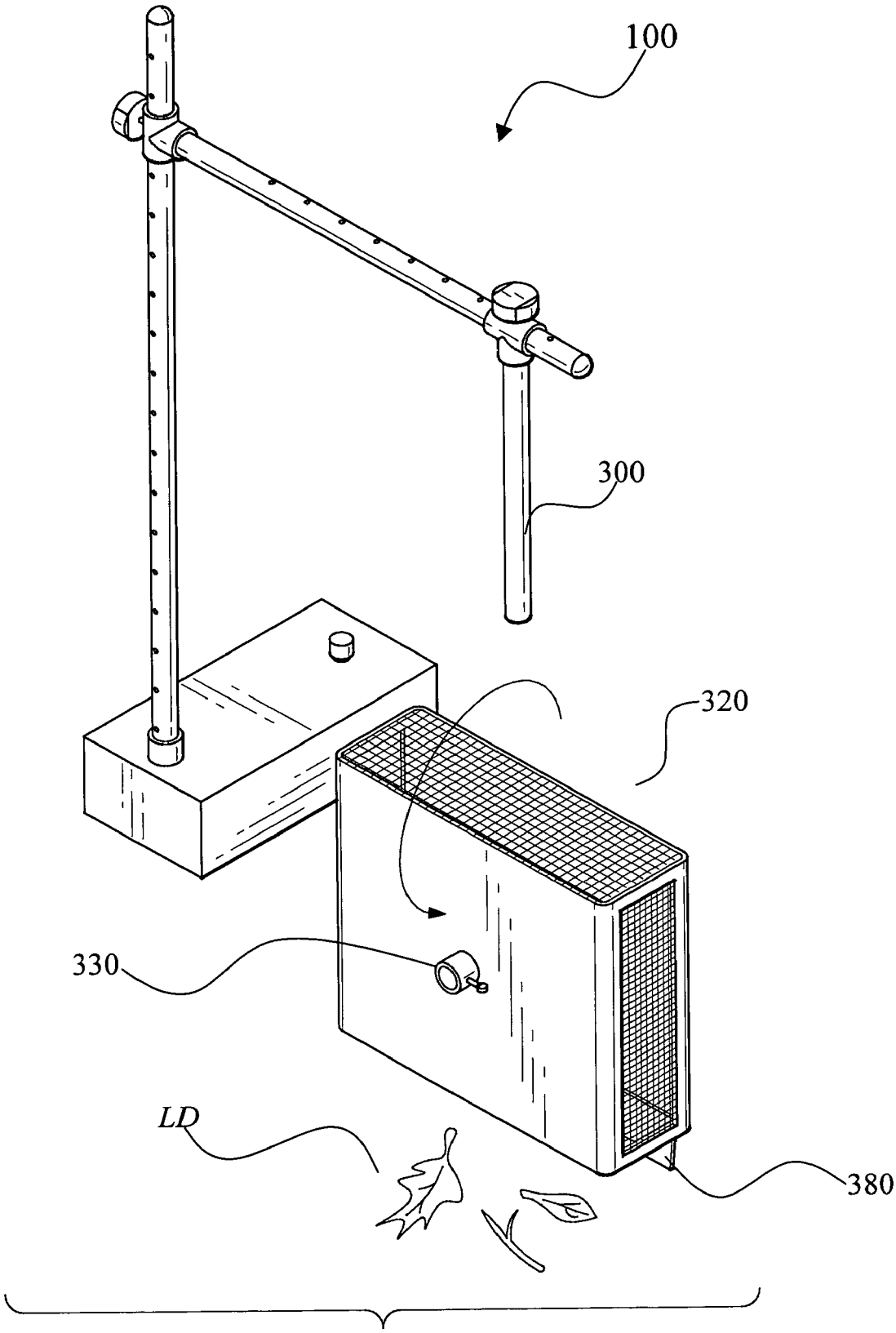

At least one catch 400 (represented by alpha-numeric labels "400*a*" and "400*b*" in FIG. 3) is used to ensure the at least one flap 380 can not open outwards while in use collecting leaves and debris from water flow 160. When it is time to empty the leaf and debris collection member 320, the at least one catch 400 is rotated to allow the at least one flap 380 to open outwardly to allow an operator, such as a swimming pool attendant or pool owner, to empty the leaf and debris collection member 320 of leaves and debris. FIGS. 5A through 5C show how the contents of the leaf and debris collection member 320 can be emptied.

It should be understood that the leaf and debris collection member 320 can take a multitude of different forms. For example, at least one water flow inlet member 340 and catches 400*a* and 400*b* can be replaced with a one-way flap designed to only open inwards thus preventing collected leaves and debris otherwise inadvertently floating back into the body of water 120. A one-way flap would work, for example, by making one or more of the water flow outlet members 360 (such as, but not limited to, one or more sieves 370) removable to allow an operator or user to remove leaves and debris collected inside the leaf and debris collection member 320.

The at least one water flow inlet member 340 (such as the at least one flap 380) is opened during normal use by water flow 160 impinging on at least one water flow inlet member 340. For example, the at least one flap 380 is shown in an open state in water flow 160 thereby allowing leaves and debris in the body of water 120 to enter the leaf and debris collection member 320. The at least one catch 400 is positioned to prevent the at least one flap 380 opening outwards. Thus, leaves and debris collected in the leaf and debris collection member 320 are not allowed to escape from the leaf and debris collection member 320.

Figure 9B:
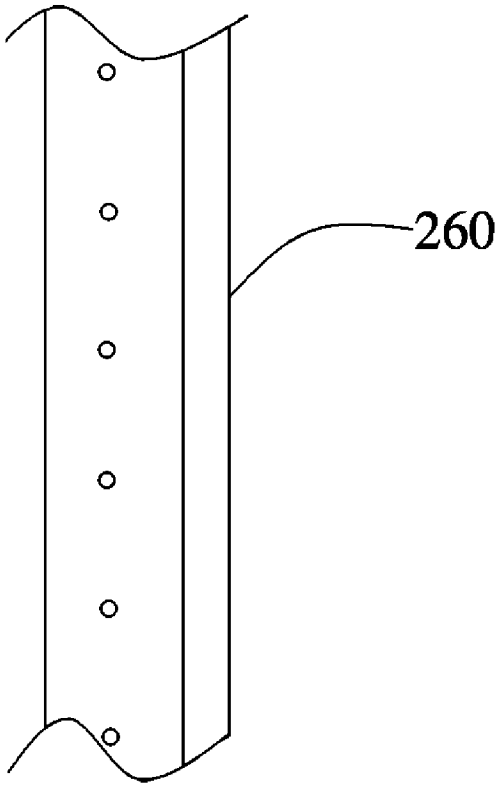
FIG. 9B shows a partial view of a first vertical support member having a rectangular cross-section according to the present invention.
Figure 9A:
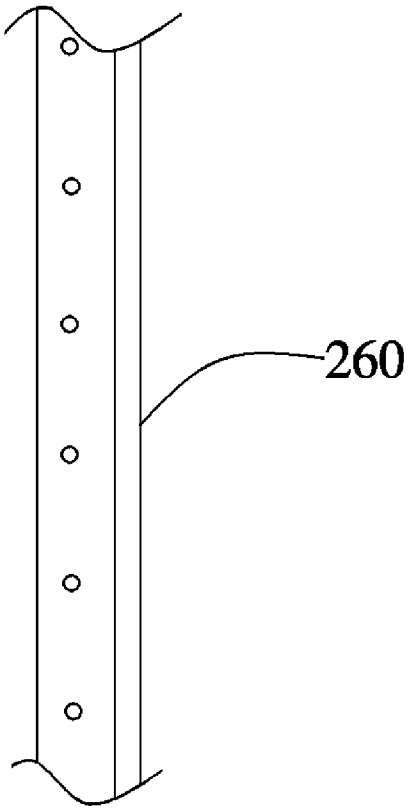
FIG. 9A shows a partial view of a first vertical support member having a square cross-section according to the present invention.
Figure 10B:
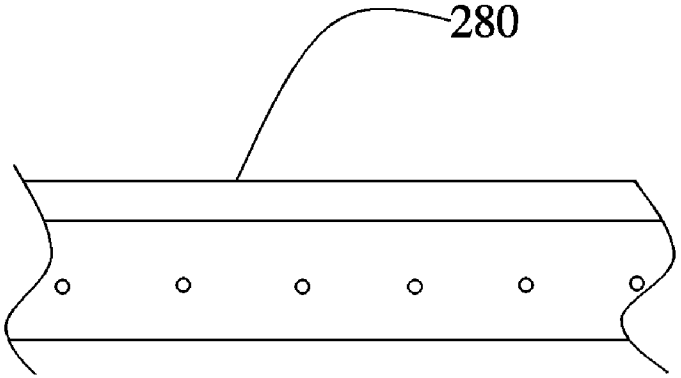
FIG. 10B shows a partial view of a second vertical support member having a rectangular cross-section according to the present invention.
Figure 10A:
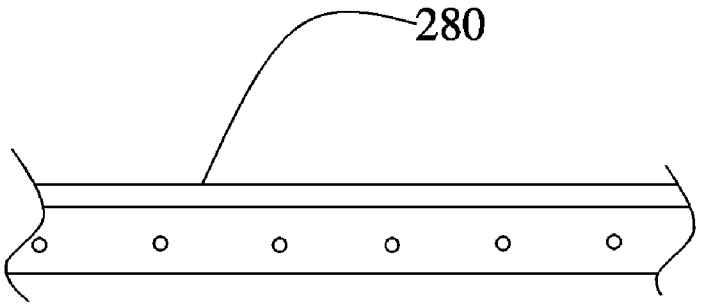
FIG. 10A shows a partial view of a second vertical support member having a square cross-section according to the present invention.
Figure 11B:
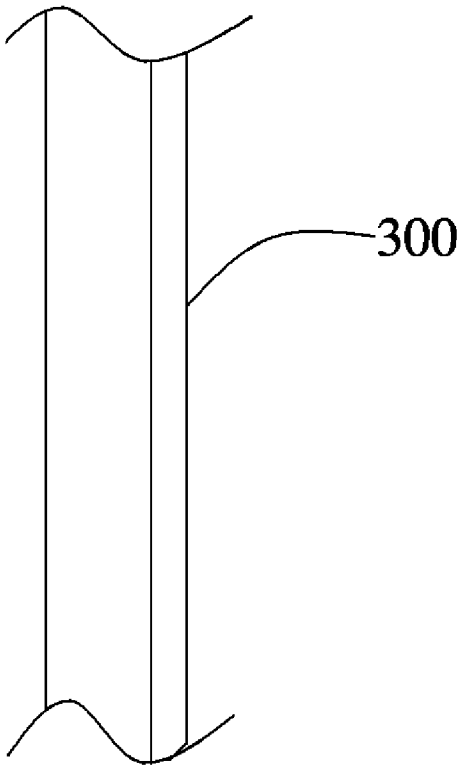
FIG. 11B shows a partial view of a horizontal support member having a rectangular cross-section according to the present invention.
Figure 11A:
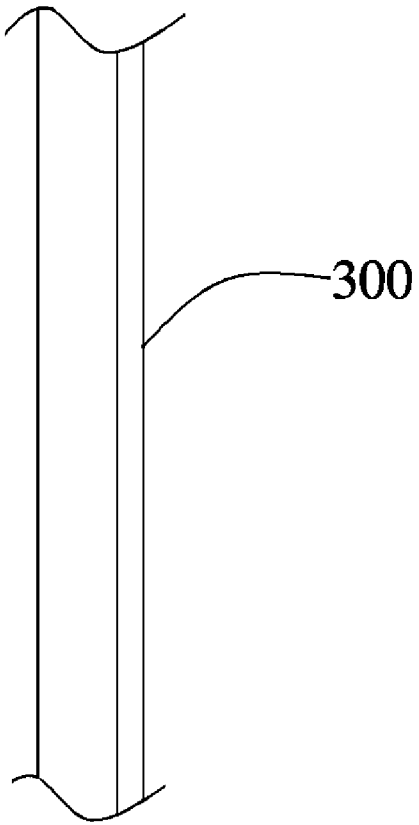
FIG. 11A shows a partial view of a horizontal support member having a square cross-section according to the present invention.

Right-angle couplers 420*a* and 420*b* are used to attach the first and second vertical members 260 and 300 to opposite ends of the horizontal member 280 as shown, for example, in FIG. 3. Right-angle coupler 420*a* allows the operator to adjust the position of horizontal member 280 with respect to first vertical member 260. Right-angle coupler 420*b* allows the operator to adjust the position of second vertical member 300 with respect to horizontal member 280. Right-angle couplers 420*a* and 420*b* can be made to resemble in appearance control dials or handles on gas stoves as shown in FIG. 3. It should be understood, however, that any suitable right-angle connector could be used. A non-limiting example of a right-angle coupler is shown in FIG. 9 in U.S. Pat. No. 5,259,690, issued Nov. 9, 1993 to Legge; the Legge patent is incorporated by reference in its entirety.

Figure 6:
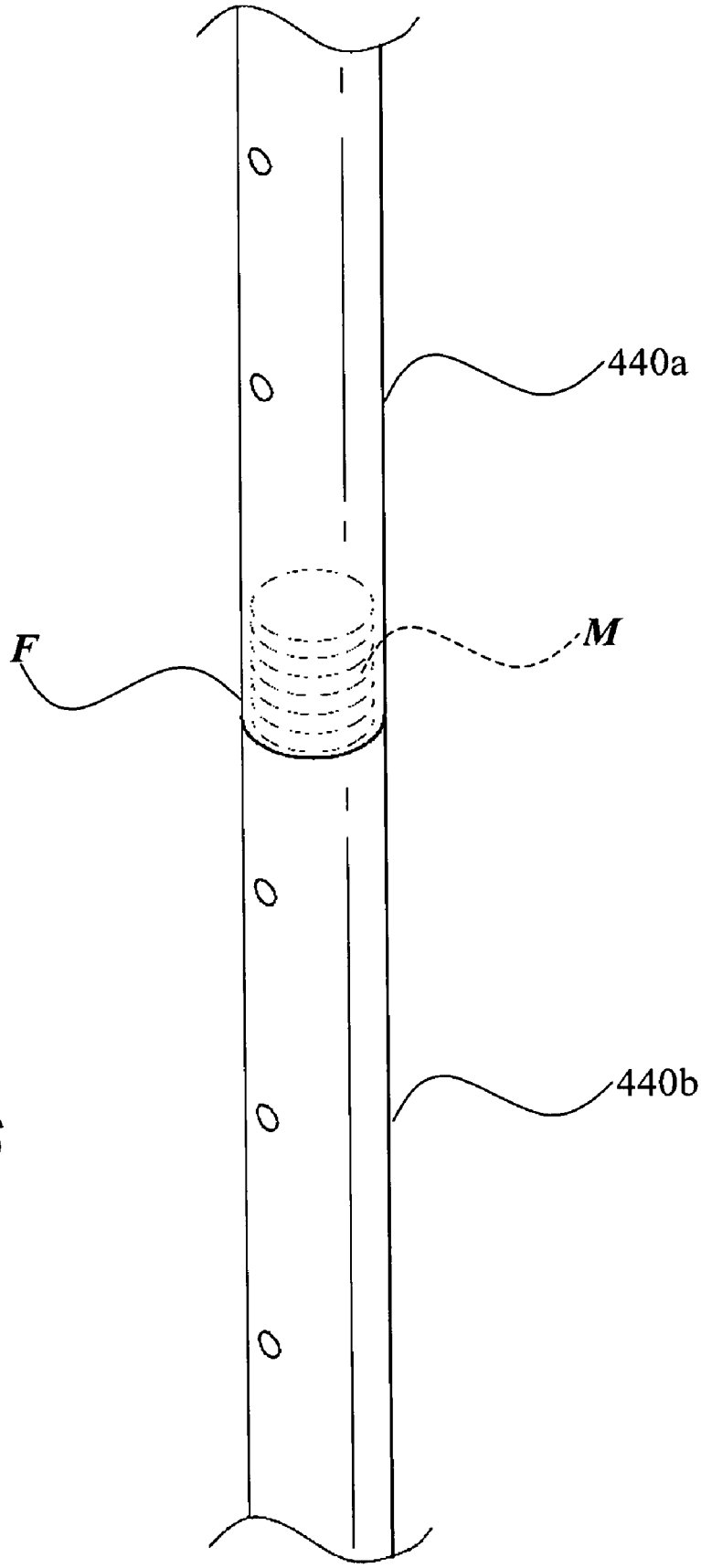
FIG. 6 shows an exemplary example of two sections of tubing joined end-to-end.

The members 260, 280 and/or 300 can be made up of sections such as, but not limited to, sections of tubing 440. The sections of tubing 440 each have a first and second opposite ends, wherein one opposite end is female F and the other opposite end is male M such that the male end M of one section of tubing 440*a* fits into the female end F of another section of tubing 440*b* (see FIG. 6) thereby joining sections of tubing 440 in series end-to-end. The first and second vertical support members 260 and 300, and the horizontal support member 280 can be made of interchangeable lengths of plastic tubing.

Figure 7:
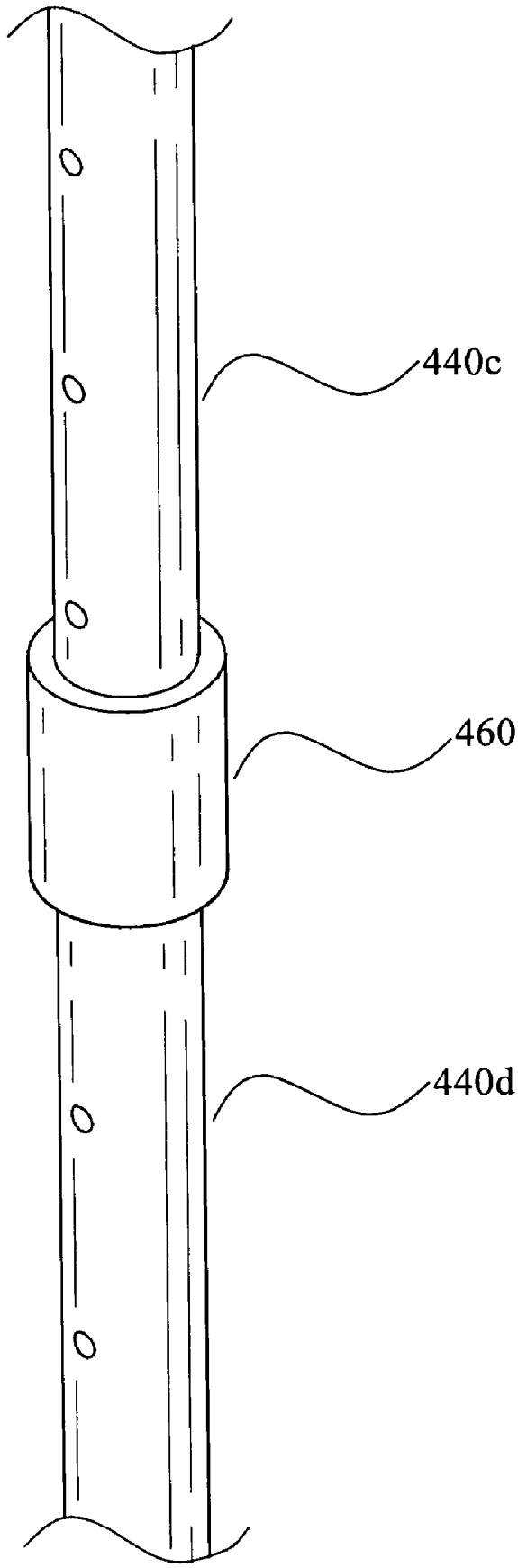
FIG. 7 shows a further exemplary example of two sections of tubing joined end-to-end.
Figure 8:
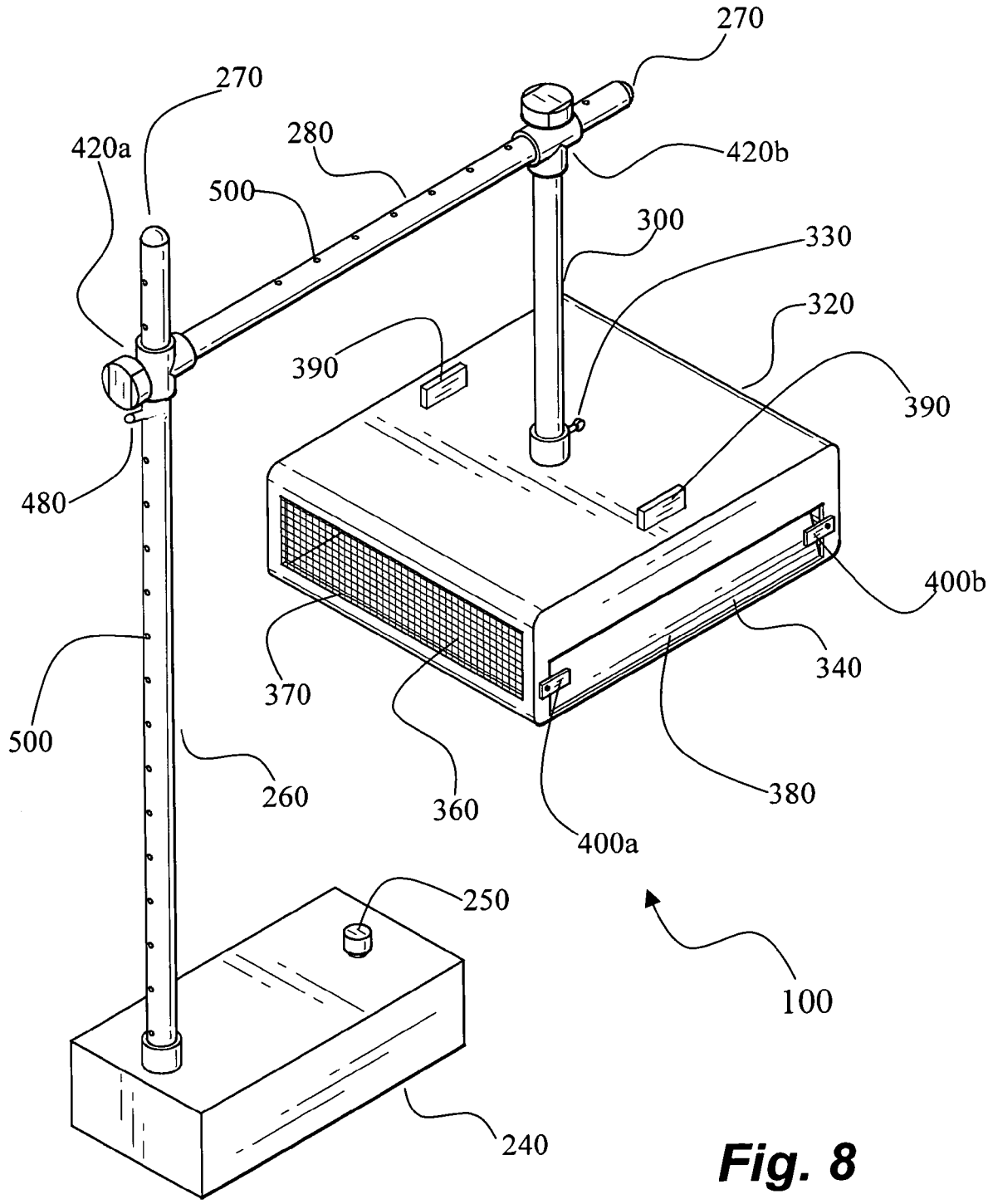
FIG. 8 shows how a bolt or pin can be used to help secure a right-angle coupler.

Also, a coupler such as a sleeve coupler 460 (see FIG. 7) can be used to adjoin two sections of tubing 440 (represented by alpha-numeric labels "440*c*" and "440*d*") end-to-end. If used, sleeve coupler 460 may take any suitable form. Sleeve coupler 460 can take a form the same or similar to that shown in FIG. 17 in U.S. Pat. No. 5,259,690, issued Nov. 9, 1993 to Legge. Instead of using a hand lever 13 described in the Legge patent, the sleeve coupler 460 or right-angle coupler 420*a* can be held in place by a bolt or pin 480 inserted into a selected aperture 500 (see FIG. 8). In the alternative, the sections 440 can take the form of tapered tubes like that used by Better Sleep Inc. In their Deluxe Tension Pole Caddy (Model 7286SN). Better Sleep Inc. is located at: 80 Industrial Road, Berkeley Heights, N.J. 07922.

It should be understood that any other suitable coupling means can be used to couple the sections of tubing 440 end-to-end. For example, the tubing coupler described in U.S. Pat. No. 2,473,388, issued Jun. 14, 1949 to I. G. Rambo, can be used to couple tubing sections 440 end-to-end; U.S. Pat. No. 2,473,388 is incorporated herein by reference in its entirety. It should also be understood that the sections of tubing 440 can have a generally square or rectangular cross-section. Stated more explicitly, sections of tubing 440 are expressly not limited to sections of tubing having a generally circular cross-section.

It should also be understood that the horizontal support member 280 and/or second vertical support member 300 are optionally made up of same sections 440 used to make up first vertical support member 260 thus enabling a human operator to add sections end-to-end to lengthen or shorten horizontal support member 280. Therefore, the sections that make up member 280 can also make use of, for example: one or more sleeves 460, the tubing coupler described in U.S. Pat. No. 2,473,388, the sleeve coupler shown in FIG. 17 in U.S. Pat. No. 5,259,690, the tapered tubes like that used by Better Sleep Inc. In their Deluxe Tension Pole Caddy (Model 7286SN), alone or in combination.

The sections of tubing can be any suitable length and diameter. For example, sections can be about 2 to 4 feet in length such as 2 feet sections with a diameter of about 0.5 to 2.5 inches, such as 2 feet sections with a diameter of about 0.5 inches. The height of the first vertical support member 260 can vary, e.g., could include a single 4 to 7 feet section; 4 feet in length made up of two 2 foot sections of tubing; 6 feet in length made up of two 3 foot sections or three 2 foot sections of tubing; 7 feet in length made up of, for example, three 2 feet sections and one 1 foot section of tubing, and so on. Likewise for the horizontal member 280 and the second vertical member 300. There is no standard lengths of measurement, any suitable number of sections of tubing from, for example, one to 5 sections of tubing; the actual dimensions of the members 260, 280 and 300 can vary according to the size of swimming pool or waterfall, and position of the outlet 200 or direction of water flow 160.

Similarly, the dimensions of the leaf and debris collection member 320 can vary without detracting from the spirit of the invention. For example, the dimensions of member 320 can be approximately one to three feet in length, one to three feet in width, and about 0.5 to about 1.5 feet in height. For example, the member can have the following non-limiting dimensions: three feet in length, two feet six inches in width and ten inches in height.

In one non-limiting example, the base is approximately 2 feet in length, 1 foot wide and about six inches high. However, the base can have any suitable shape and possess any set of suitable dimensions as would be understood by a person of ordinary skill in the art.

The first vertical member 260 can be made of separate sections that join end-to-end or might be a single section of tubing with any suitable cross-section (CS) such as, but not limited to, circular CS, a rectangular CS, a regular polygonal CS, an irregular polygonal CS, a square CS.

Figure 4:
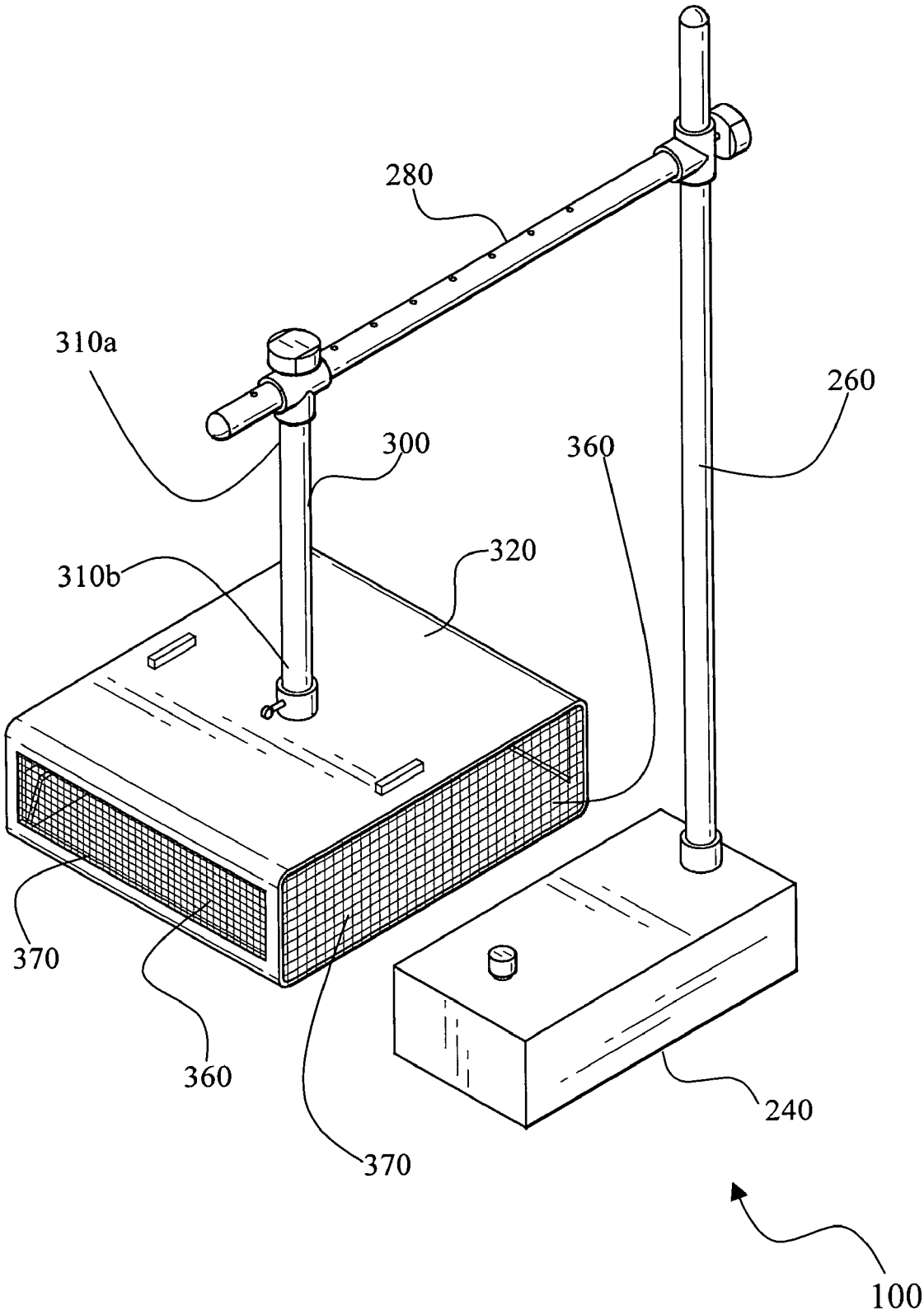
FIG. 4 is a further perspective view of the leaf and debris catcher shown in FIGS. 1 and 2.

Referring to FIG. 4, which shows a further perspective view of the leaf and debris catcher 100 according to the invention. Of particular note is the orientation of the base 240 with respect to the first vertical support member 260. The base 240 is optionally not restricted to a particular position in the horizontal plane.

Referring to FIG. 5A, the horizontal support member 280 can be rotated in the horizontal plane in a controlled fashion by an operator by manipulating right-angle coupler 420*a*. The second vertical support member 300 can be rotated in the vertical plane in a controlled fashion by an operator manipulating right-angle coupler 420*b*. The leaf and debris collection member 320 can be optionally moved to a new position in the horizontal plane by an operator manipulating the release mechanism 330.

With respect to FIG. 5B, the release mechanism 330 is typically used to release the leaf and debris collection member 320 from the second vertical support member 300.

FIG. 5C shows the leaf and debris collection member 320 being emptied of leave and debris matter LD by manipulating the leaf and debris collection member 320 until the leave and debris matter LD falls out via the at least one flap 380.

In one aspect of the invention, a method is provided for removing leaves from a body of water 120. The method includes the steps of: providing a leaf and debris collection member 320; positioning said leaf and debris collection member 320 in a body of water such that the leaf and debris collection member 320 is located in a flow of water; collecting leaves in the leaf and debris collection member 320; removing the leaf and debris collection member 320 from the flow of water; and removing leaves from the leaf and debris collection member 320.

Wherein the step of positioning the leaf and debris collection member 320 in a flow of water further comprises the step of positioning the leaf and debris collection member 320 in a flow of water 160 generated, for example, by a swimming pool outlet. It would be well understood that the position of the leaf and debris collection member 320 with respect to the swimming pool outlet (such as, but not limited to, swimming pool outlet 200) is easily worked out by an operator who merely has to position the leaf and debris collection member 320 at any position and orientation where member 340 is forced open by the flow of water 160. Thus, the actual position chosen for the leaf and debris collection member 320 depends on the strength of water flow 160 and the ease with which member 340 (such as at least one flap 380) opens to allow water to travel into member 320 and through member 360, such as (but not limited to), at least one sieve 370.

In the alternative, the step of positioning the leaf and debris collection member 320 in a flow of water further comprises the step of positioning the leaf and debris collection member 320 in a flow of water generated by a waterfall or the functional equivalent of a waterfall.

It is to be understood that the present invention is not limited to the embodiments described above, but encompasses any and all embodiments within the scope of the following claims.

I claim:

1. A leaf and debris catcher for removing leaves and debris in outflow water driven through an outlet by a water circulation pump, comprising:

a base;

a first vertical support member connected to and extending upward from said base;

a horizontal support member connected to and extending outward from said vertical support member;

a second vertical support member having proximal and distal opposite ends, said proximal end connected to and extending downward from said horizontal support member; and a leaf and debris catcher member attached to said distal end of said second vertical support member, wherein said leaf and debris catcher member comprises at least one water flow inlet member and at least one water flow outlet member, wherein said at least one water flow inlet member comprises a flap, wherein during normal operation said flap opens inwards in response to water flow impinging on said at least one water flow inlet member.

2. The leaf and debris catcher of claim 1, wherein said first vertical support member, said second vertical support member and said horizontal support member are made of interchangeable lengths of plastic tubing.

3. The leaf and debris catcher of claim 1, wherein said first vertical support member, said second vertical support member and said horizontal support member are made of interchangeable lengths of metal tubing.

4. The leaf and debris catcher of claim 1, wherein said first vertical support member, said second vertical support member and said horizontal support member have a circular cross-section.

5. The leaf and debris catcher of claim 1, wherein said first vertical support member, said second vertical support member and said horizontal support member have a square cross-section.

6. The leaf and debris catcher of claim 1, wherein said first vertical support member, said second vertical support member and said horizontal support member have a rectangular cross-section.

7. The leaf and debris catcher of claim 1, wherein said leaf and debris catcher member has a generally rectangular box shape.

8. A method of removing leaves from a body of water such as a swimming pool or waterfall, the method comprising the steps of:

providing a leaf and debris collection member (320), wherein said leaf and debris catcher member (320) comprises at least one water flow inlet member (340) and at least one water flow outlet member (360), wherein said at least one water flow inlet member (340) comprises at least one flap (380), wherein during normal operation said at least one flap (380) opens inwards in response to water flow impinging on said at least one water flow inlet member (340), wherein said at least one water flow outlet member (360) comprises at least one sieve (370);

positioning said leaf and debris collection member (320) in a body of water such that said leaf and debris collection member is located in a flow of water;

collecting leaves in said leaf and debris collection member (320);

removing said leaf and debris collection member (320) from the flow of water; and removing leaves from said leaf and debris collection member (320).

9. The method according to claim 8, wherein the step of positioning said leaf and debris collection member (320) in a flow of water further comprises the step of positioning said leaf and debris collection member (320) in a flow of water generated by a swimming pool outlet.

10. The method according to claim 8, wherein the step of positioning said leaf and debris collection member (320) in a flow of water further comprises the step of positioning said leaf and debris collection member (320) in a flow of water generated by a water fall.

* * * * *